US009013393B2

(12) United States Patent
Um et al.

(10) Patent No.: US 9,013,393 B2
(45) Date of Patent: Apr. 21, 2015

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Jae-Eun Um, Cheonan-si (KR); Jin-Taek Hong, Incheon (KR)

(73) Assignee: Samsung Display Co., Ltd. (KR)

( * ) Notice: Subject to any disclaimer, the term of this patent is extended or adjusted under 35 U.S.C. 154(b) by 1182 days.

(21) Appl. No.: 12/419,220

(22) Filed: Apr. 6, 2009

(65) Prior Publication Data

US 2010/0039456 A1 Feb. 18, 2010

(30) Foreign Application Priority Data

Aug. 12, 2008 (KR) ..... 10-2008-0079059

(51) Int. Cl.
*G09G 3/36* (2006.01)
*G09G 3/34* (2006.01)

(52) U.S. Cl.
CPC ..... *G09G 3/3426* (2013.01); *G09G 2320/064* (2013.01); *G09G 2330/06* (2013.01); *G09G 2360/16* (2013.01)

(58) Field of Classification Search
CPC ..... G09G 3/34; G09G 3/3406; G09G 3/342; G09G 3/3426; G09G 2320/0633; G09G 2320/064; G09G 2320/0646
USPC ..... 345/694–695, 204, 102–103; 315/297, 315/317–319
See application file for complete search history.

(56) References Cited

U.S. PATENT DOCUMENTS

| | | | | |
|---|---|---|---|---|
| 5,844,540 | A | 12/1998 | Terasaki | |
| 6,111,559 | A * | 8/2000 | Motomura et al. | 345/102 |
| 2002/0003525 | A1 * | 1/2002 | Hwang | 345/102 |
| 2004/0145560 | A1 * | 7/2004 | Kim | 345/102 |
| 2004/0183822 | A1 * | 9/2004 | Woo | 345/691 |
| 2005/0068289 | A1 | 3/2005 | Diefenbaugh et al. | |
| 2006/0007103 | A1 | 1/2006 | Oh et al. | |
| 2006/0208999 | A1 | 9/2006 | Lee et al. | |
| 2007/0152926 | A1 | 7/2007 | Kwon | |

FOREIGN PATENT DOCUMENTS

| | | | |
|---|---|---|---|
| JP | 2004-266594 | A | 9/2004 |
| KR | 10-0537680 | | 12/2004 |
| KR | 1020040103549 | A | 12/2004 |
| KR | 10-2005-0015187 | | 2/2005 |
| KR | 10-2007-0025176 | | 3/2007 |

OTHER PUBLICATIONS

European Search Report corresponding to application No. EP09004617.8, Jan. 25, 2011, 10 pages.

* cited by examiner

*Primary Examiner* — Jonathan Horner
(74) *Attorney, Agent, or Firm* — Innovation Counsel LLP

(57) ABSTRACT

In a method of driving a light source of a light source module including a plurality of driving blocks, an image signal is analyzed and a target luminance corresponding to each of the driving blocks is determined. A dimming level of each of the driving blocks is determined by using the target luminance. A driving signal is generated, and the driving signal has a pulse width based on the dimming level and a variable frequency in accordance with a processing mode of the image signal. The driving block is driven by using the driving signal.

19 Claims, 8 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

PRIORITY STATEMENT

The present application claims priority under 35 U.S.C. §119 to Korean Patent Application No. 2008-79059, filed on Aug. 12, 2008 in the Korean Intellectual Property Office (KIPO), the contents of which are herein incorporated by reference in their entirety.

BACKGROUND OF THE INVENTION

1. Field of the Invention

Example embodiments of the present invention relate to a method of driving a light source, a light source apparatus for performing the method, and a display apparatus having the light source apparatus. More particularly, example embodiments of the present invention relate to a method of driving a light source for removing noise, a light source apparatus for performing the method, and a display apparatus having the light source apparatus.

2. Description of the Related Art

Generally, a liquid crystal display (LCD) apparatus includes an LCD panel displaying an image using optical transmittance of liquid crystal molecules and a backlight assembly disposed below the LCD panel to provide the LCD panel with light.

The LCD panel includes an array substrate, a color filter substrate and a liquid crystal layer. The array substrate includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate. When an electric field generated between the pixel electrode and the common electrode is applied to the liquid crystal layer, the arrangement of liquid crystal molecules of the liquid crystal layer is altered to change the optical transmissivity of the liquid crystal layer, so that an image is displayed on the LCD panel. The LCD panel displays a white image of a high luminance when an optical transmittance is increased to maximum, and the LCD panel displays a black image of a low luminance when the optical transmittance is decreased to minimum.

Recently, a method of local dimming the backlight assembly having a plurality driving blocks has been developed. In the method of local dimming, the driving blocks of the backlight assembly are individually controlled according to the gray scale of an image displayed on the LCD panel. However, there are some problems with the method of local dimming.

Firstly, the driving blocks are repeatedly driven to turn light on and off to cause noise. The noise may increase when the frequency of the noise is higher. Secondly, a TFT of the LCD panel may be affected by the light being turned on and off of the driving blocks to cause waterfall noise. Thirdly, the light source may cause flicker when a driving signal suddenly changes from a high level into a low level to change the current level of the driving signal.

A design of an inverter and a printed circuit board (PCB) has been developed to prevent the flicker. However, the inverter and the PCB have difficulty in preventing the noise and the waterfall noise. The waterfall noise may be prevented when interference between the frequency of the driving signal and a frame frequency is reduced to minimum.

However, the image signal is commonly transmitted by using an NTSC mode, a PAL mode, etc. In the NTSC mode and the PAL mode, the frame frequencies are different from each other, so that the width of a frequency band in which the waterfall noise is not generated is very narrow. Also, the frequency band satisfying the NTSC mode and PAL modes satisfying the frequency band is too high. Thus, the noise may be increased.

SUMMARY OF THE INVENTION

Example embodiments of the present invention provide a method of local dimming a light source capable of enhancing display quality.

Example embodiments of the present invention provide a light source apparatus for performing the above-mentioned method.

Example embodiments of the present invention provide a display apparatus having the above-mentioned light source apparatus.

According to one aspect of the present invention, in a method of driving a light source of a light source module including a plurality of driving blocks, an image signal is analyzed and a target luminance corresponding to each of the driving blocks is determined. A dimming level of the driving block is determined by using the target luminance. A driving signal is generated, and the driving signal has a pulse width based on the dimming level and a variable frequency in accordance with a processing mode of the image signal. The driving block is driven by using the driving signal.

According to another aspect of the present invention, a light source apparatus includes a light source module and a light source driving part. The light source module comprises a plurality of driving blocks, and each of the driving blocks includes a light source generating light. The light source driving part analyzes an image signal to determine a dimming level of the driving block, and drives the light source by using a driving signal having a pulse width corresponding to the dimming level and a variable frequency in accordance with a processing mode of the image signal.

According to still another aspect of the present invention, a display apparatus includes a display panel, a light source module and a light source driving part. The display panel comprises a plurality of display blocks to display an image. The light source module comprises a plurality of driving blocks, and each of the driving blocks includes a light source generating light. The light source driving part analyzes an image signal to determine a dimming level of the driving block, and drives the light source by using a driving signal having a pulse width based on the dimming level and a variable frequency in accordance with a processing mode of the image signal.

According to some example embodiments of the present invention, the frequency of a driving signal is changed in accordance with an image processing mode, so that waterfall noise and noise may be prevented.

BRIEF DESCRIPTION OF THE DRAWINGS

The above and other advantages of the present invention will become more apparent by describing in detail example embodiments thereof with reference to the accompanying drawings, in which.

DETAILED DESCRIPTION OF THE INVENTION

Figure 1:
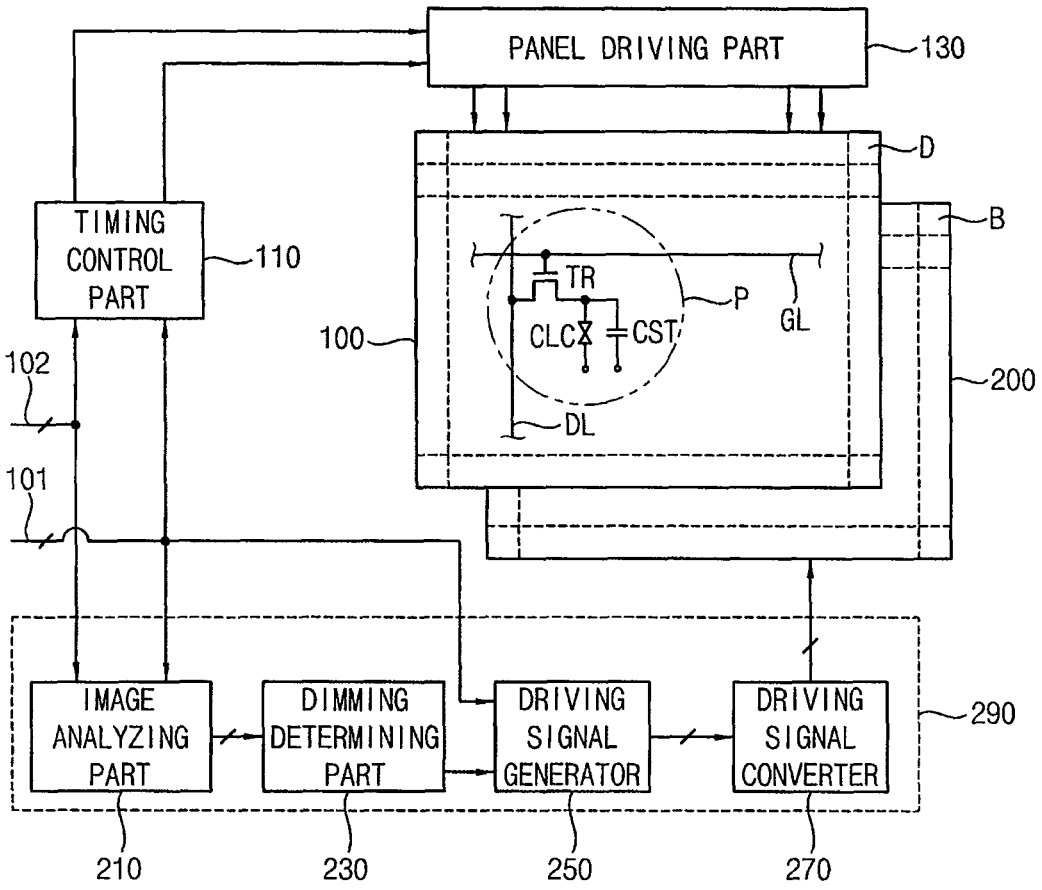
FIG. 1 is a block diagram illustrating a display apparatus according to an Embodiment 1 of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

FIG. 1 is a block diagram illustrating a display apparatus according to an Embodiment 1 of the present invention.

Referring to FIG. 1, the display apparatus includes a display panel 100, a timing control part 110, a panel driving part 130, a light source module 200 and a light source driving part 290.

The display panel 100 includes a plurality of pixels displaying an image. For example, the number of the pixels may be M×N (wherein M and N are natural numbers). Each pixel P includes a switching element TR connected to a gate line GL and a data line DL, a liquid crystal capacitor CLC and a storage capacitor CST that are connected to the switching element TR. The display panel 100 includes a plurality of display blocks D. For example, the display blocks D may be divided into a line shape and a matrix shape corresponding to the driving blocks of the light source module 200. When the driving blocks include a lamp, the display blocks D may be divided into the line shape. When the driving blocks include a light-emitting diode (LED), the display blocks D may be divided into the matrix shape.

The timing control part 110 receives a synchronization signal 101 and an image signal 102. The timing control part 110 generates a timing control signal that controls a timing of driving the display panel 100 by using the synchronization signal 101. The timing control signal includes a clock signal, a horizontal synchronization signal, and a vertical synchronization signal. The timing control part 110 receives a synchronization signal of the image signal processed in accordance with the NTSC mode, PAL mode, SECAM mode, etc.

The panel driving part 130 drives the display panel 100 by using the synchronization signal 101 and the image signal 102 provided from the timing control part 110. For example, the panel driving part 130 includes a gate driving part and a data driving part. The gate driving part generates a gate signal by using the vertical synchronization signal to provide the signal to the gate line GL. The data driving part generates a data signal by using the horizontal synchronization signal to provide the signal to the data line DL.

The light source module 200 includes a plurality of light sources providing light to the display panel 100. A light source may include the lamp or the LED. The light source module 200 is divided into a plurality of driving blocks, each of the driving blocks including the light sources. The driving blocks may be individually driven and may correspond to the display blocks D of the display panel 100.

The light source driving part 290 includes an image analyzing part 210, a dimming determining part 230, a driving signal generator 250, and a driving signal converter 270.

The image analyzing part 210 determines a target luminance by using the synchronization signal 101 and the image signal 102. For example, the image analyzing part 210 analyzes the image signal of one frame, and determines the target luminance of the display blocks D corresponding to the driving blocks B.

The dimming determining part 230 determines a dimming level by using the target luminance, and the dimming level determines the luminance of each of the driving blocks.

The driving signal generator 250 generates a first driving signal by using the dimming level, and the first driving signal controls the amount of light emitted from the driving block B. The driving signal generator 250 determines an image processing mode by using the synchronization signal 101, and generates the first driving signal having a frequency corresponding to the image processing mode. The synchronization signal 101 includes the vertical synchronization signal and the horizontal synchronization signal.

For example, when the frequency of the first driving signal is about 150 Hz in the NTSC mode, the waterfall noise may be minimal and the noise may be removed. Thus, the driving signal generator 250 generates the first driving signal having the frequency of about 150 Hz in the NTSC mode. In addition, when the frequency of the first driving signal is about 125 Hz in the PAL mode, the waterfall noise may be minimal and the noise may be removed. Thus, the driving signal generator 250 generates the first driving signal having the frequency of about 125 Hz in the PAL mode.

The driving signal converter 270 converts the driving signal into a converted signal having a signal type corresponding to the light source included in the light source module 200. The first driving signal has a pulse width based on the dimming level and a variable frequency in accordance with the image processing mode. The driving signal converter 270 may be an inverter when the light source is the lamp, and the inverter converts a direct current (DC) voltage into an alternating current (AC) voltage. The driving signal converter 270 may be a converter when the light source is the LED, and the converter converts the AC voltage into the DC voltage.

Figure 2:
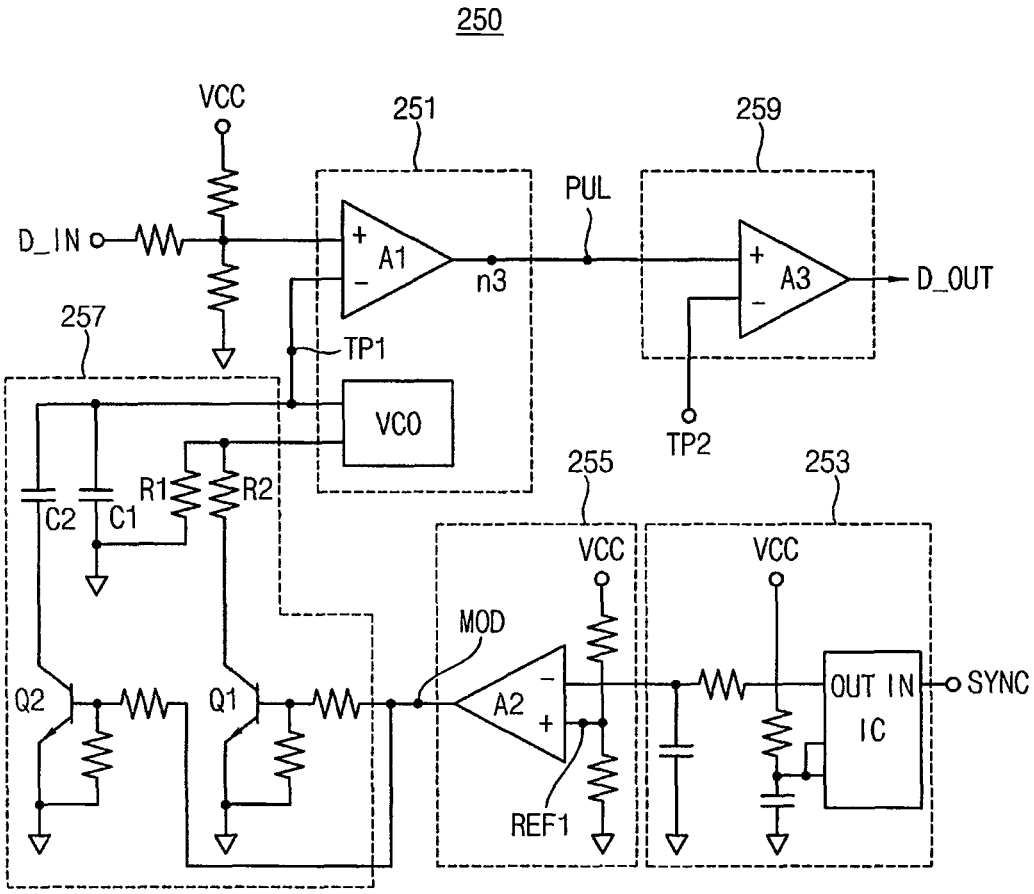
FIG. 2 is a circuit diagram illustrating the driving signal generator of FIG. 1.
Figure 3A:
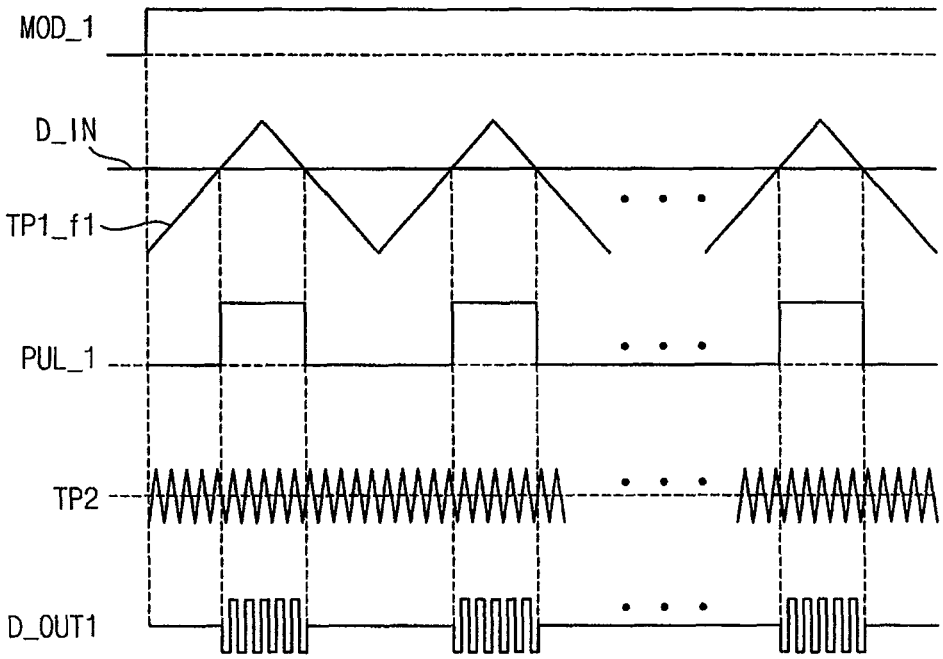
FIGS. 3A and 3B are timing diagrams illustrating input and output signals of the driving signal generator of FIG. 2.
Figure 3B:
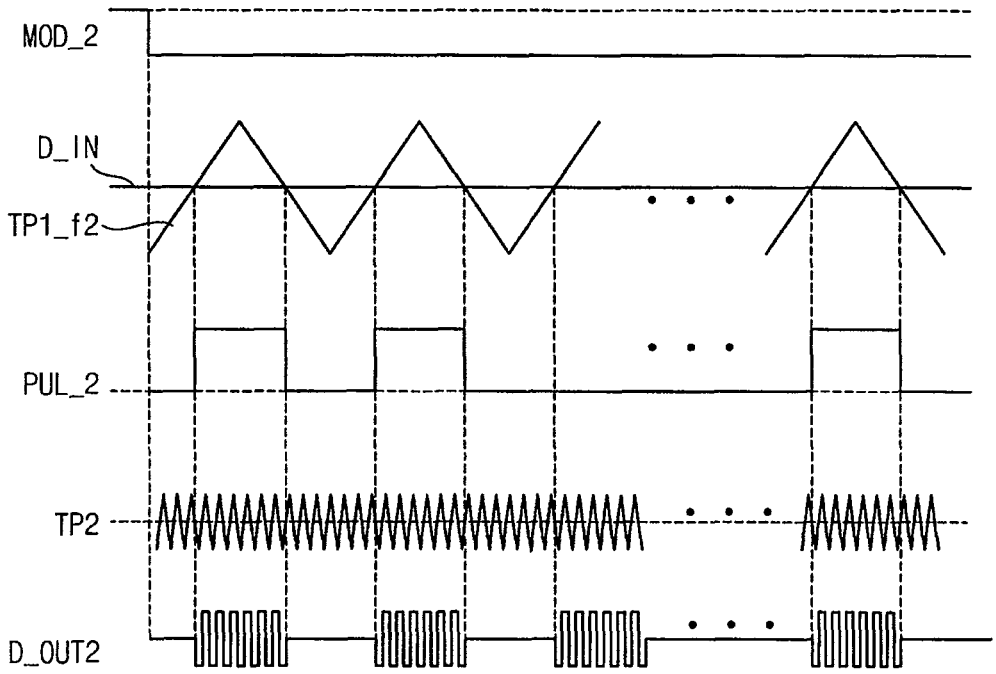

FIG. 2 is a circuit diagram illustrating the driving signal generator 250 of FIG. 1. FIGS. 3A and 3B are timing diagrams illustrating input and output signals of the driving signal generator 250 of FIG. 2.

Referring to FIGS. 2, 3A and 3B, the driving signal generator 250 includes a pulse-generating part 251, a frequency-voltage converter 253, a mode determining part 255, a frequency changing part 257 and an output part 259.

The pulse-generating part 251 includes a voltage-controlled oscillator (VCO) and a first comparator A1, and generates a driving pulse. The first comparator A1 has a reference terminal and an input terminal. The reference terminal receives a dimming level D_IN of the DC voltage and the input terminal receives a first triangle wave TP1 generated from the VCO. The frequency of the first triangle wave may be changed by a time constant of a resistor and a capacitor included in the frequency changing part 257. The width of the driving pulse is determined by the dimming level, and the frequency of the driving pulse is determined by the time constant of the resistor and the capacitor included in the frequency changing part 257.

The frequency-voltage converter 253 receives the synchronization signal SYNC (e.g., synchronization signal 101) in the external, and converts the synchronization signal SYNC into a selection signal by using the frequency of the synchronization signal SYNC. The selection signal has a level corresponding to the frequency of the synchronization signal SYNC.

The mode determining part 255 includes a second comparator A2. The second comparator A2 has a reference terminal receiving a reference signal REF1 set up and an input terminal receiving the selection signal. The second comparator A2 compares the selection signal and the reference signal REF1 to output a first mode signal or a second mode signal. For example, when the selection signal is lower than the reference signal, the mode determining part 255 outputs the first mode signal of a high level. When the selection signal is higher than the reference signal, the mode determining part 255 outputs the second mode signal of a low level.

The frequency changing part 257 includes a first resistor R1, a first capacitor C1, a first transistor Q1, a second resistor R2, a second capacitor C2, and a second transistor Q2. A first end of the first resistor R1 is connected to a first end of the VCO, a first end of the first capacitor C1 is connected to a second end of the VCO, and a second end of the first resistor R1 is connected to a second end of the first capacitor C1.

A first end of the second resistor R2 is connected to the first end of the first resistor R1 in parallel with the first resistor R1, and a first end of the second capacitor C2 is connected to the first end of the first capacitor C1 in parallel with the first capacitor C1. A second end of the second resistor is connected to an input terminal of the first transistor Q1 and a second end of the second capacitor C2 is connected to an input terminal of the second transistor Q2. Control terminals of the first and second transistors Q1 and Q2 receive an output signal of the mode determining part 255.

When the control terminals of the first and second transistors Q1 and Q2 receive the first mode signal of the high level, the first and second transistors Q1 and Q2 are turned on. The frequency changing part 257 outputs the first triangle wave TP1 having a first frequency inversely proportional to the time constant of the first and second resistors R1 and R2 and the first and second capacitors C1 and C2. When the control terminals of the first and second transistors Q1 and Q2 receive the second mode signal of the low level, the first and second transistors Q1 and Q2 are turned off. The frequency changing part 257 outputs the first triangle wave TP1 having a second frequency inversely proportional to the time constant of the first resistor R1 and the first capacitor C1.

The second resistor R2 operates to lower the frequency of the first triangle wave, and the second capacitor C2 operates to raise the frequency of the first triangle wave. Thus, when the second resistor R2 and the second capacitor C2 are set to have suitable constant values, the frequency changing part 257 may generate the first triangle waves TP1 having the first and second frequencies, respectively.

The output part 259 includes a third comparator A3. The third comparator A3 includes a reference terminal receiving a second triangle wave TP2 and an input terminal receiving the driving pulse generated from the pulse-generating part 251. The second triangle wave TP2 regularity maintains a current of the driving pulse. The frequency of the second triangle wave TP2 is about 30 kHz to about 70 kHz. For example, when the duty ratio of the driving pulse is about 100%, the current of the driving pulse is maintained at about 70 mA. The output part 259 outputs the driving pulse as the first driving signal by using the second triangle wave TP2. The frequency of the first driving signal is changed into the first or second frequency in accordance with the selection signal.

For example, when the frequency-voltage converter 253 receives the synchronization signal SYNC of the PAL mode, the frequency-voltage converter 253 outputs a first selection signal having a level corresponding to the frequency of the synchronization signal as shown in FIG. 3A. The mode determining part 255 receives the first selection signal, and the mode determining part 255 compares the first selection signal and the reference signal REF1 to output a first mode signal MOD_1 of a high level.

The frequency changing part 257 receives the first mode signal MOD_1. When the control terminals of the first and second transistors Q1 and Q2 receive the first mode signal MOD_1 of the high level, respectively, the first and second transistors Q1 and Q2 are turned on. The VCO generates the first triangle wave TP1 having a first frequency f1 by the time constant of the first and second resistors R1 and R2, and the first and second capacitors C1 and C2.

The pulse-generating part 251 generates the first driving pulse PUL_1 by using the dimming level D_IN and the first triangle wave TP1 having the first frequency f1. The output part 259 outputs the first driving signal D_OUT1 by using the first driving pulse PUL_1 and the second triangle wave TP2.

Therefore, in the PAL mode, the driving signal generator 250 outputs the first driving signal D_OUT1 having the first frequency f1. For example, the first frequency f1 may be about 125 Hz.

As shown in FIG. 3B, when the frequency-voltage converter 253 receives the synchronization signal SYNC of the NTSC mode, the frequency-voltage converter 253 outputs a second selection signal having a level corresponding to the frequency of the synchronization signal. The mode determining part 255 receives the second selection signal, and the mode determining part 255 compares the second selection signal and the reference signal REF1 to output a second mode signal MOD_2 of a low level.

The frequency changing part 257 receives the second mode signal MOD_2. When the control terminals of the first and second transistors Q1 and Q2 receive the second mode signal MOD_2 of the low level, respectively, the first and second transistors Q1 and Q2 are turned off. The VCO generates the first triangle wave TP1 having the second frequency f2 by the time constant of the first resistors R1 and the first capacitors C1.

The pulse-generating part 251 generates the second driving pulse PUL_2 by using the dimming level D_IN and the first triangle wave TP1 having the second frequency f2. The output part 259 outputs the second driving signal D_OUT2 by using the second driving pulse PUL_2 and the second triangle wave TP2.

Therefore, in the NTSC mode, the driving signal generator 250 outputs the second driving signal D_OUT2 having the second frequency f2. For example, the second frequency f2 may be about 150 Hz.

Figure 4:
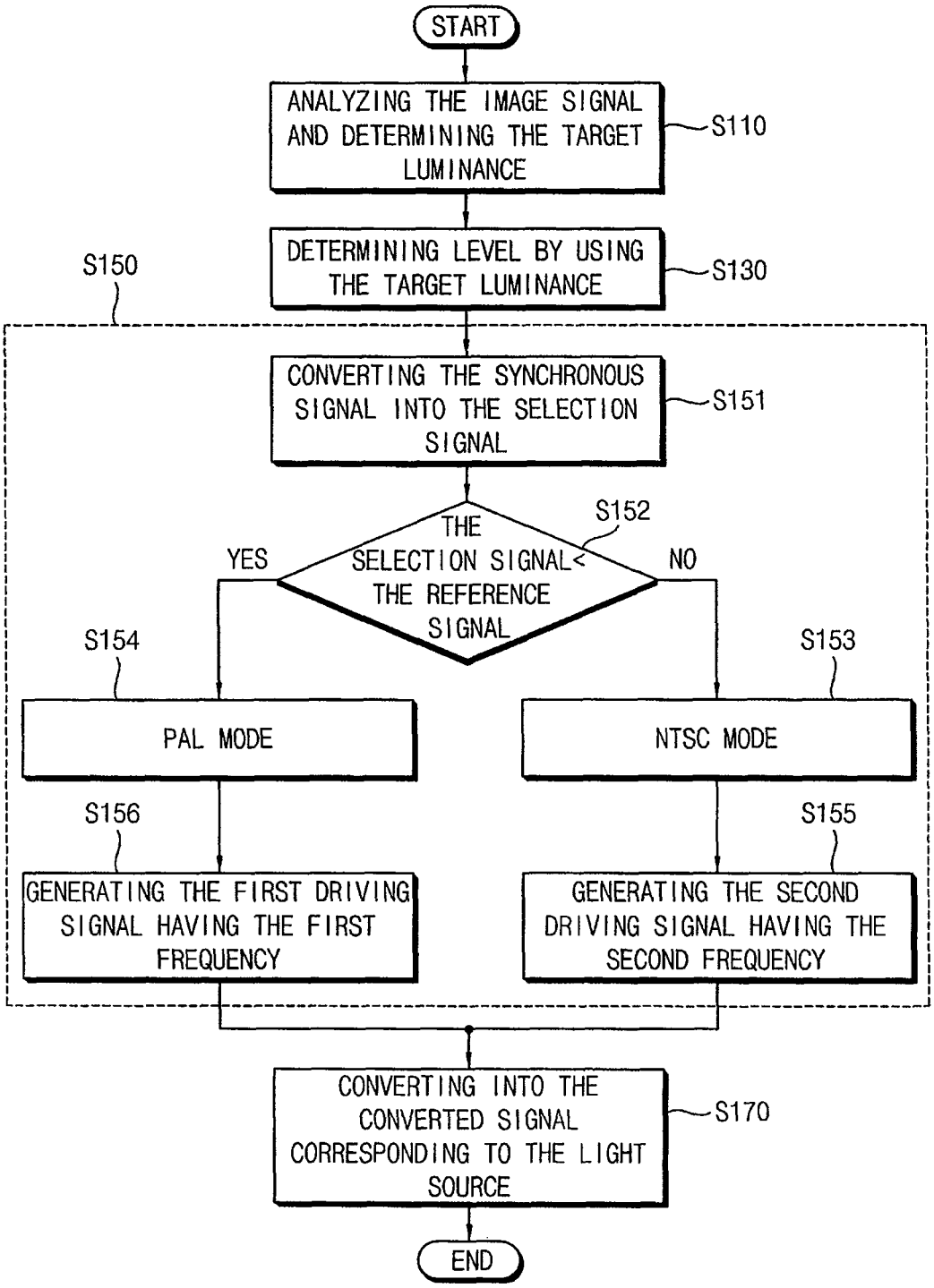
FIG. 4 is a flowchart showing a method of driving the light source module of FIG. 1.

FIG. 4 is a flowchart showing a method of driving a light source module of FIG. 1.

Referring to FIGS. 1, 2 and 4, the image analyzing part 210 analyzes the image signal received from an external source to determine the target luminance of the display block D corresponding to the driving block B (step S110).

The dimming determining part 230 determines a dimming level by using the target luminance, and the dimming level determines the luminance of the driving block (step S130).

The driving signal generator 250 generates a first driving signal by using the dimming level, and the first driving signal driving the driving block B (step S150). The first driving signal has the frequency corresponding to the image processing mode.

The driving signal generator 250 converts the synchronization signal SYNC received in the external into the selection signal (step S151). The driving signal generator 250 compares the selection signal and the reference signal to determine the image processing mode (step S152). For example, when the selection signal is lower than the reference signal, the driving signal generator 250 determines the PAL mode (step S154). The driving signal generator 250 generates the first driving signal having the first frequency corresponding to the PAL mode (step S156). When the selection signal is higher than the reference signal, the driving signal generator 250 determines the NTSC mode (step S153). The driving signal generator 250 generates the second driving signal having the second frequency different from the first frequency corresponding to the NTSC mode (step S155).

When the frequency of the first driving signal is about 150 Hz in the NTSC mode, the waterfall noise may be minimal and the noise may be removed. In addition, when the frequency of the first driving signal is about 125 Hz in the PAL mode, the waterfall noise may be minimal and the noise may be removed. Thus, the driving signal generator 250 generates the first driving signal having the frequency of about 150 Hz in the NTSC mode and the driving signal generator 250 generates the first driving signal having the frequency of about 125 Hz in the PAL mode.

The driving signal converter 270 converts the driving signal into a converted signal having a signal type corresponding to the light source included in the light source module 200 (step S170). For example, the driving signal converter 270 may be the inverter or the converter.

Figure 5:
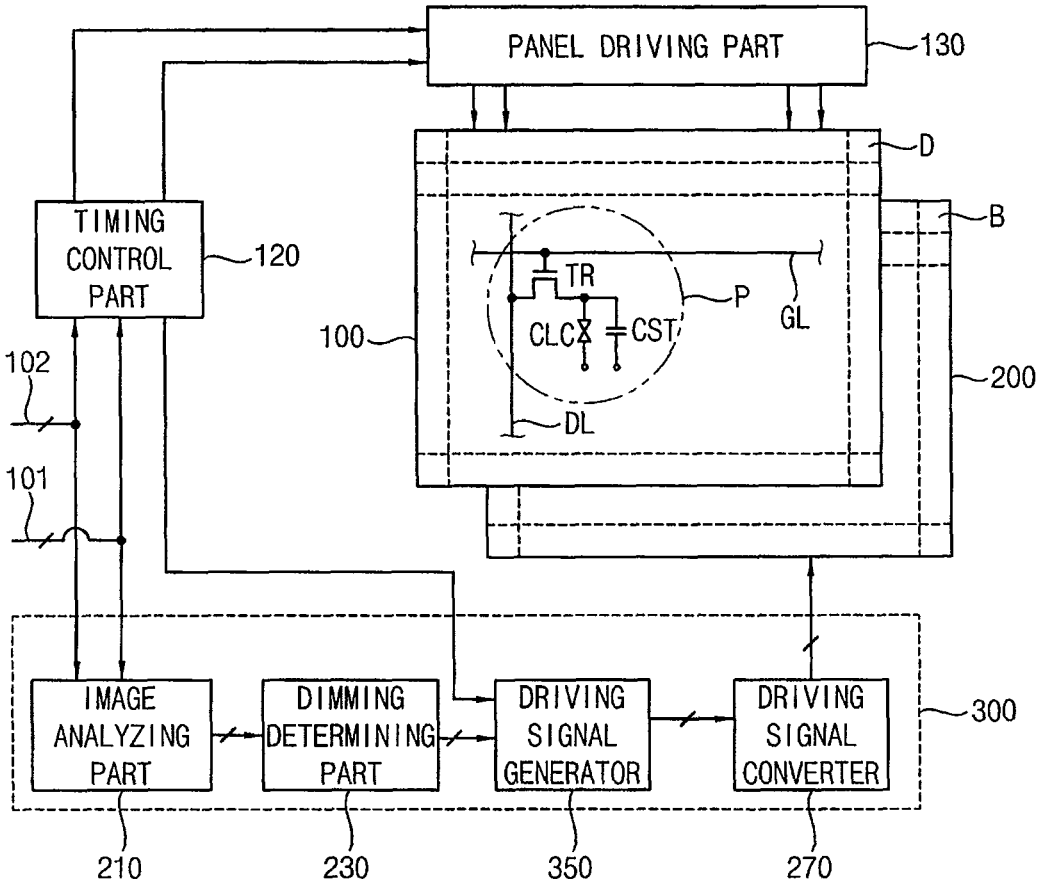
FIG. 5 is a block diagram illustrating a display apparatus according to an Embodiment 2 of the present invention.

FIG. 5 is a block diagram illustrating a display apparatus according to an Embodiment 2 of the present invention. The display apparatus according to an Embodiment 2 is substantially the same as the display apparatus according to the Embodiment 1 except for the timing control part and the driving signal generator. Hereinafter, the same reference numerals will be used to refer to the same or like parts as those described in the first embodiment and any further repetitive explanation concerning the above elements will be omitted.

Referring to FIG. 5, the display apparatus includes a display panel 100, a timing control part 120, a panel driving part 130, a light source module 200, and a light source driving part 300. The light source driving part 300 includes an image analyzing part 210, a dimming determining part 230, a driving signal generator 350, and a driving signal converter 270.

The timing control part 120 receives a synchronization signal 101 and an image signal 102. The timing control part 120 generates a timing control signal that controls a timing of driving the display panel 100 by using the synchronization signal 101.

The timing control part 120 determines an image processing mode by using the synchronization signal 101 to provide a mode signal corresponding to the image processing mode with the driving signal generator 350. For example, when the image processing mode is a PAL mode the timing control part 120 outputs a first mode signal of a high level, and when the image processing mode is an NTSC mode the timing control part 120 outputs a second mode signal of a low level.

The driving signal generator 350 changes the frequency of a driving signal in response to the mode signal provided to the timing control part 110. The driving signal generator 350 generates the first driving signal having a variable frequency in accordance with the image processing mode.

Figure 6:
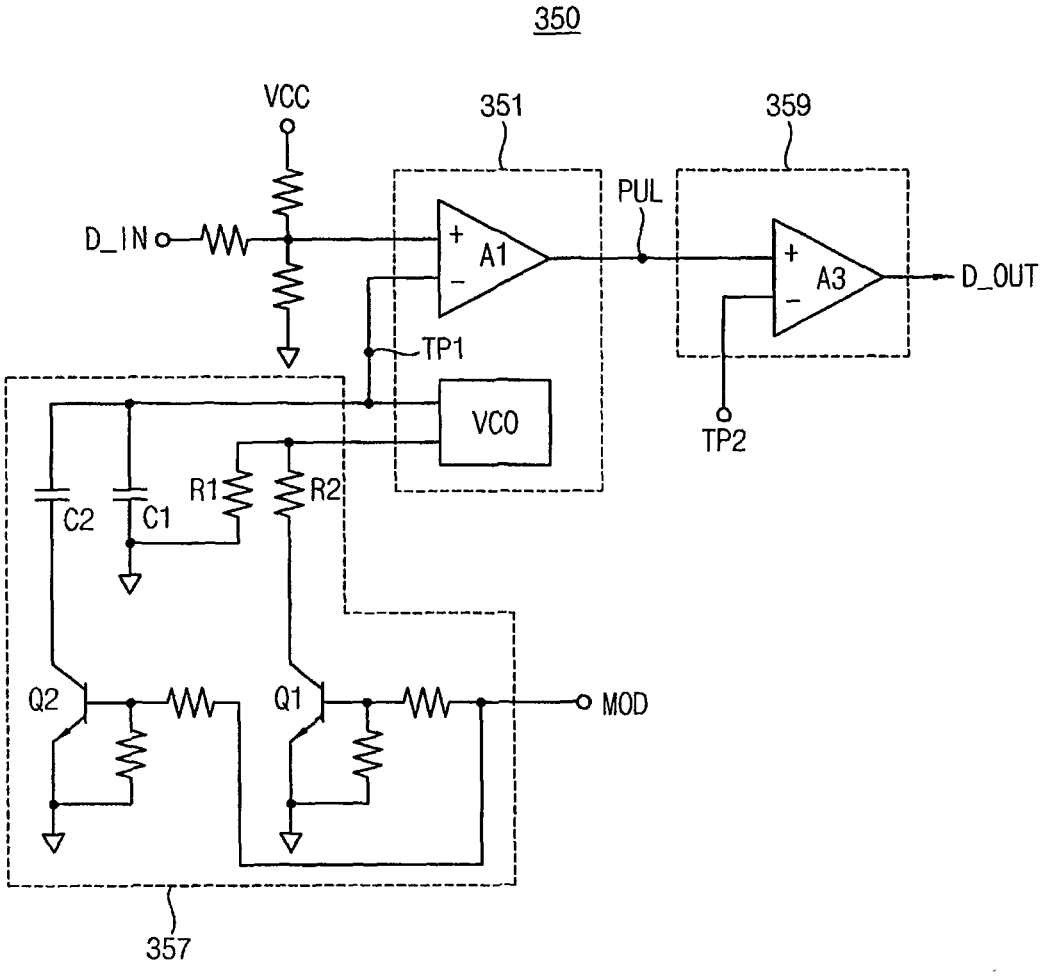
FIG. 6 is a circuit diagram illustrating the driving signal generator of FIG. 5.

FIG. 6 is a circuit diagram illustrating the driving signal generator of FIG. 5.

Referring to FIGS. 5 and 6, the driving signal generator 350 includes a pulse-generating part 351, a frequency changing part 357 and an output part 359.

The pulse-generating part 351 includes a VCO and a first comparator A1, and generates a driving pulse. The first comparator A1 has a reference terminal and an input terminal. The reference terminal receives a dimming level D_IN of the DC voltage and the input terminal receives a first triangle wave TP1 generated from the VCO. The frequency of the first triangle wave may be changed by a time constant of a resistor and a capacitor included in the frequency changing part 357. The width of the driving pulse is determined by the dimming level, and the frequency of the driving pulse is determined by the time constant of the resistor and the capacitor included in the frequency changing part 357.

The frequency changing part 357 includes a first resistor R1, a first capacitor C1, a first transistor Q1, a second resistor R2, a second capacitor C2, and a second transistor Q2. The frequency changing part 357 is substantially the same as the frequency changing part 257 according to the Embodiment 1 shown in FIG. 2 except for the mode signal MOD provided to the timing control part 120.

When the control terminals of the first and second transistors Q1 and Q2 receive the first mode signal of the high level, the first and second transistors Q1 and Q2 are turned on. The frequency changing part 357 outputs the first triangle wave TP1 having a first frequency inversely proportional to the time constant of the first and second resistors R1 and R2 and the first and second capacitors C1 and C2. When the control terminals of the first and second transistors Q1 and Q2 receive the second mode signal of the low level, the first and second transistors Q1 and Q2 are turned off. The frequency changing part 257 outputs the first triangle wave TP1 having a second frequency inversely proportional to the time constant of the first resistors R1 and the first capacitors C1. Thus, when the second resistor R2 and the second capacitor C2 are set to have constant values, the frequency changing part 357 may generate the first triangle waves TP1 having the first and second frequencies, respectively.

The output part 359 includes a third comparator A3. The third comparator A3 includes a reference terminal receiving a second triangle wave TP2 of the low frequency and an input terminal receiving the driving pulse generated from the pulse-generating part 351. The output part 359 outputs the driving pulse as the first driving signal by using the second triangle wave TP2. The frequency of the first driving signal is changed into the first or second frequency in accordance with the selection signal.

Figure 7:
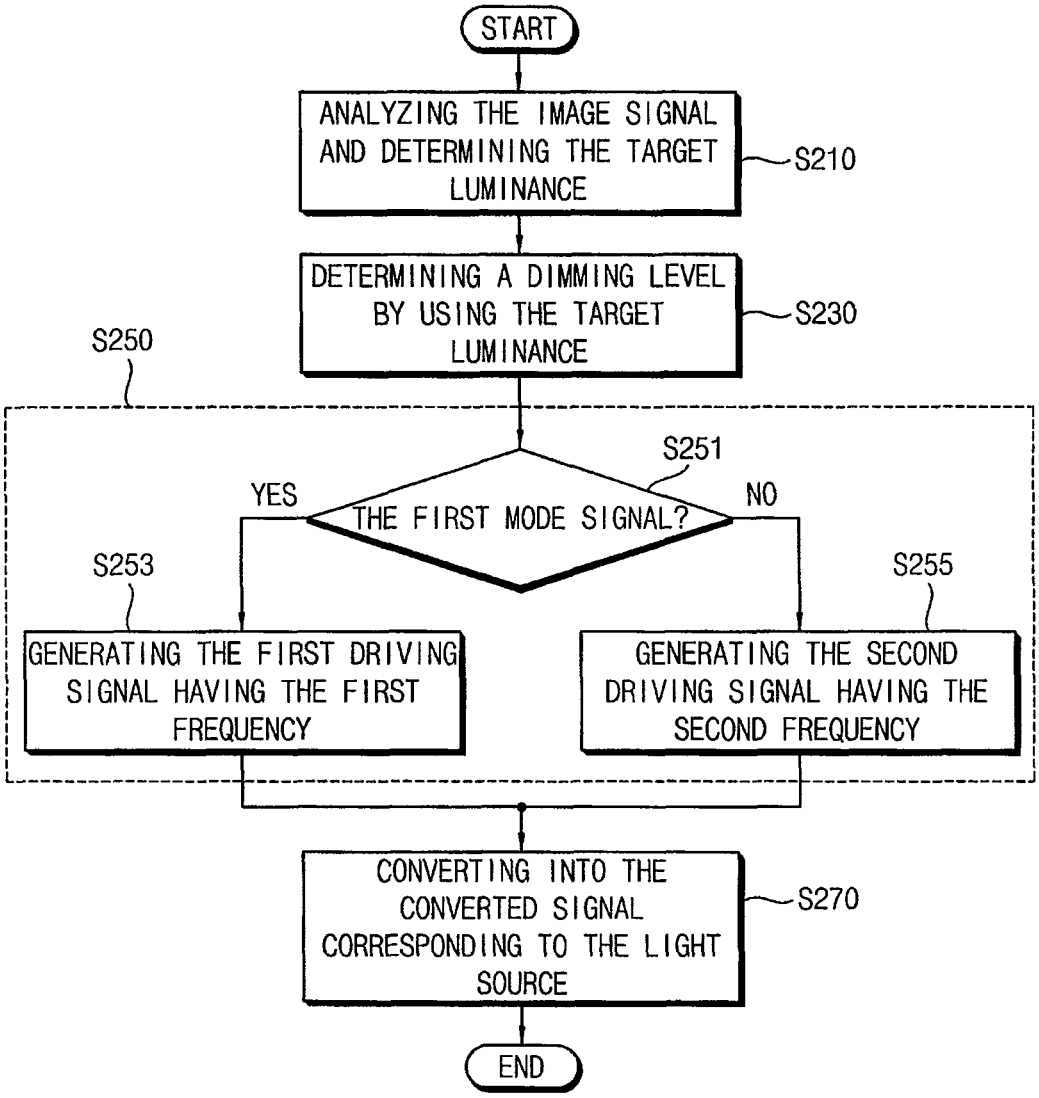
FIG. 7 is a flowchart illustrating a method of driving the light source module of FIG. 5.

FIG. 7 is a flowchart illustrating a method of driving the light source module of FIG. 5.

Referring to FIGS. 5 and 7, the image analyzing part 210 analyzes the image signal received from an external source to determine the target luminance of the display block D corresponding to the driving block B (step S210).

The dimming determining part 230 determines a dimming level by using the target luminance, and the dimming level determines the luminance of the driving block (step S230).

The driving signal generator 350 generates the first driving signal corresponding to the driving block B in response to the dimming level and the mode signal provided to the timing control part 120 (step S250).

When the driving signal generator 350 receives the first mode signal corresponding to the PAL mode from the timing control part 120 (step S251), the driving signal generator 350 generates the first driving signal having the first frequency corresponding to the PAL mode (step S253). When a mode signal is not the first mode signal, the driving signal generator 350 determines the mode signal to be a second mode signal to generate the first driving signal having the second frequency corresponding to the NTSC mode (step S255).

The driving signal converter 270 converts the driving signal into the converted signal having a signal type corresponding to the light source included in the light source module 200 (step S270). For example, the driving signal converter 270 may be the inverter or the converter.

Therefore, the light source module may be driven by using the driving signal having the frequency which is capable of removing the waterfall noise and the noise of the low frequency in accordance with the image processing mode.

According to the present invention, the frequency of a driving signal is changed in accordance with an image processing mode, so that waterfall noise and the noise may be prevented.

This invention has been described with reference to the example embodiments. It is evident, however, that many alternative modifications and variations will be apparent to those having skill in the art in light of the foregoing description. Accordingly, the present invention embraces all such alternative modifications and variations as falling within the spirit and scope of the appended claims.

What is claimed is:

1. A method of driving a light source of a light source module including a plurality of driving blocks, the method comprising:

receiving into the light source module an image signal including a synchronization signal of the image signal and having a variable television broadcast transmission mode, the synchronization signal of the image signal including vertical and horizontal synchronization signals;

analyzing the image signal to determine a target luminance corresponding to each of the driving blocks;

determining a dimming level of each of the driving blocks by using the target luminance;

generating a driving signal of each of the driving blocks, each driving signal having a pulse width based on the dimming level and a frequency determined using the synchronization signal of the image signal in accordance with the variable television broadcast transmission mode of the image signal, by inputting the dimming level and a triangle wave into a comparator, wherein a frequency of the triangle wave is determined by a mode signal input into a frequency determining part, the mode signal having one of a high level and a low level based on the synchronization signal, the mode signal having the high level turning on two transistors in the frequency determining part receiving the mode signal to generate the triangle wave with a first frequency and the mode signal having the low level turning off the two transistors receiving the mode signal to generate the triangle wave having a second frequency different from the first frequency; and driving each of the driving blocks by using the generated driving signal.

2. The method of claim 1, wherein generating the driving signal comprises:

receiving the synchronization signal of the image signal;

converting the synchronization signal into a selection signal;

generating the mode signal corresponding to the variable television broadcast transmission mode of the image signal by using the selection signal and a reference signal that is pre-determined.

3. The method of claim 1, wherein each of the plurality of driving blocks comprises a light source generating light, and wherein driving each of the driving blocks comprises:

converting the driving signal into a converted signal having a signal type corresponding to the light source; and applying the converted signal to the light source.

4. The method of claim 3, wherein the light source includes a lamp, and the converted signal is an alternating current (AC) voltage.

5. The method of claim 3, wherein the light source includes a light-emitting diode (LED), and the converted signal is a direct current (DC) voltage.

6. A light source apparatus comprising:

a light source module comprising a plurality of driving blocks, each of the driving blocks including a light source generating light; and a light source driving part for analyzing an image signal to determine a dimming level of each of the driving blocks, and for driving the light source by using a driving signal having a pulse width corresponding to the dimming level and a frequency determined using a synchronization signal of the image signal and received with the image signal in accordance with a variable television broadcast transmission mode of the image signal, wherein the light source driving part includes:

a mode determining part for generating one of a high level mode signal and a low level mode signal corresponding to the variable television broadcast transmission mode of the image signal; and a frequency changing part including a first transistor having a first control terminal and a second transistor having a second control terminal, wherein the first and second control terminals each receive the one of the high level mode signal and the low level mode signal from the mode determining part and, in response to the high level mode signal the first and second transistors are in an on state and the frequency of the driving signal output is a first frequency, and in response to a low level mode signal the first and second transistors are in an off state and the frequency of the driving signal generated is a second frequency.

7. The light source apparatus of claim 6, wherein the light source driving part comprises:

an image analyzing part that analyzes the image signal to determine a target luminance corresponding to each of the driving blocks;

a dimming determining part that determines the dimming level of each of the driving blocks by using the target luminance;

a driving signal generator that generates the driving signal having a variable frequency in accordance with the variable television broadcast transmission mode of the image signal; and a driving signal converter that converts the driving signal into a converted signal having a signal type corresponding to the light source.

8. The light source apparatus of claim 7, wherein the driving signal generator includes:

a pulse-generating part for generating the driving signal having a pulse width based on the dimming level and a variable frequency in accordance with the variable television broadcast transmission mode of the image signal.

9. The light source apparatus of claim 8, further comprising:

a frequency-voltage converter for receiving a synchronization signal of the image signal and for converting the synchronization signal into a selection signal; and wherein the mode determining part for generates the mode signal corresponding to the variable television broadcast transmission mode of the image signal by using the selection signal and a reference signal that is pre-determined.

10. The light source apparatus of claim 8, wherein the frequency changing part comprises:

a first resistor including a first end connected to a voltage-controlled oscillator (VCO) generating a triangle wave;

a first capacitor including:

a first end connected to the VCO; and a second end connected to a second end of the first resistor;

a second resistor including a first end connected to the first end of the first resistor;

the first transistor further including:

an input terminal connected to a second end of the second resistor;

a second capacitor including a first end connected to the first end of the first capacitor; and the second transistor further including:

an input terminal connected to a second end of the second capacitor.

11. The light source apparatus of claim 7, wherein the light source includes a lamp, and the converted signal is an AC voltage.

12. The light source apparatus of claim 7, wherein the light source includes an LED, and the converted signal is a DC voltage.

13. A display apparatus comprising:

a display panel comprising a plurality of display blocks and configured to receive an image signal and to display an image using the image signal, the image signal including a synchronization signal of the image signal and having a variable television broadcast transmission mode, the synchronization signal of the image signal include vertical and horizontal synchronization signals;

a light source module comprising a plurality of driving blocks, each of the driving blocks including a light source generating light; and a light source driving part for analyzing the image signal to determine a dimming level of each of the driving blocks, and for driving the light source by using a driving signal having a pulse width corresponding to the dimming level and a frequency determined using the synchronization signal of the image signal in accordance with the variable television broadcast transmission mode of the image signal, wherein the light source driving part includes:

a mode determining part for generating one of a high level mode signal and a low level mode signal corresponding to the variable television broadcast transmission mode of the image signal; and a frequency changing part including a first transistor having a first control terminal and a second transistor having a second control terminal, wherein the first and second control terminals each receive the one of the high level mode signal and the low level mode signal from the mode determining part and, in response to the high level mode signal the first and second transistors are in an on state and the frequency of the driving signal output is a first frequency, and in response to a low level mode signal the first and second transistors are in an off state and the frequency of the driving signal generated is a second frequency.

14. The display apparatus of claim 13, wherein the light source driving part comprises:

an image analyzing part that analyzes the image signal to determine a target luminance corresponding to each of the driving blocks;

a determining part that determines the dimming level of each of the driving blocks by using the target luminance;

a driving signal generator that generates the driving signal having a variable frequency in accordance with the variable television broadcast transmission mode of the image signal; and a driving signal converter that converts the driving signal into a converted signal having a signal type corresponding to the light source.

15. The display apparatus of claim 14, wherein the driving signal generator comprises:

a frequency-voltage converter for receiving a synchronization signal of the image signal and for converting the synchronization signal into a selection signal;

wherein the mode determining part for generates the mode signal corresponding to the variable television broadcast transmission mode of the image signal by using the selection signal and a reference signal that is pre-determined;

and a pulse-generating part for generating the driving signal having a pulse width based on the dimming level and a variable frequency in accordance with the variable television broadcast transmission mode of the image signal.

16. The display apparatus of claim 14, further comprising:

a timing controlling part for determining the variable television broadcast transmission mode of the image signal, and for applying the mode signal to the driving signal generator.

17. The display apparatus of claim 16, wherein the driving signal generator comprises:

a pulse-generating part that generates the driving signal having a pulse width based on the dimming level and a variable frequency in accordance with the variable television broadcast transmission mode of the image signal.

18. The display apparatus of claim 14, wherein the light source includes a lamp, and the converted signal is an AC voltage.

19. The display apparatus of claim 14, wherein the light source includes an LED, and the converted signal is a DC voltage.

* * * * *